United States Patent [19]

Noguchi et al.

[11] Patent Number: 4,517,286

[45] Date of Patent: May 14, 1985

[54] COLOR DIFFUSION TRANSFER LIGHT-SENSITIVE ELEMENT WITH AMINE SOLVENT

[75] Inventors: Yasuhiro Noguchi; Masakazu Morigaki, both of Kanagawa, Japan

[73] Assignee: Fuji Photo Film Co., Ltd., Japan

[21] Appl. No.: 557,301

[22] Filed: Dec. 2, 1983

[30] Foreign Application Priority Data

Dec. 2, 1982 [JP] Japan ..... 57-211943

[51] Int. Cl.[3] ..... G03C 1/40; G03C 5/54

[52] U.S. Cl. ..... 430/562; 430/218; 430/222; 430/223; 430/546; 430/559

[58] Field of Search ..... 430/218, 222, 546, 559, 430/562, 223

[56] References Cited

U.S. PATENT DOCUMENTS

| | | | |
|---|---|---|---|
| 2,322,027 | 6/1943 | Jelley et al. | 430/546 |
| 3,336,135 | 8/1967 | Terashima et al. | 430/372 |
| 3,705,035 | 12/1972 | Vetter et al. | 430/218 |
| 4,336,322 | 6/1982 | Fujita et al. | 430/218 |
| 4,404,273 | 9/1983 | Forte et al. | 430/546 |

*Primary Examiner*—Richard L. Schilling
*Attorney, Agent, or Firm*—Sughrue, Mion, Zinn, Macpeak, and Seas

[57] ABSTRACT

A color diffusion transfer process light-sensitive element is disclosed. The element is comprised of a support having coated thereon a light-sensitive silver halide emulsion layer which is associated with a dye image-providing compound. The dye image-providing compound is dispersed in a copresent state with a compound represented by the general formula (I):

(I)

wherein the substituents within the general formula (I) are defined within the specification. The element has improved maximum image density and by utilizing the compound of the general formula (I) it is possible to obtain improved dispersion stability.

18 Claims, No Drawings

COLOR DIFFUSION TRANSFER LIGHT-SENSITIVE ELEMENT WITH AMINE SOLVENT

FIELD OF THE INVENTION

This invention relates to a diffusion transfer process light-sensitive element containing a dye image-providing compound such as a dye-releasing redox compound. More particularly, in association with development of silver halide, it relates to a diffusion transfer process light-sensitive element containing a high-boiling organic solvent capable of stably dispersing in a hydrophilic binder a dye-releasing redox compound or the like which can release a diffusible image-forming dye (including its precursor) under alkaline conditions.

BACKGROUND OF THE INVENTION

It has been well known to use in a color photographic light-sensitive element a high-boiling organic solvent for dispersing oil-soluble additives. For example, with respect to dispersion of dye-releasing redox compounds or the like, *Research Disclosure,* Vol. 176, the December issue, No. 17643 (1978) describes a process other than a process of directly dispersing a dye-releasing redox compound by mechanical means; a process of dispersing a dye-releasing redox compound or the like by dissolving it in a high-boiling solvent as illustrated in U.S. Pat. No. 2,322,027 granted to Jelley et al. and U.S. Pat. No. 2,801,171 granted to Fierke et al. and dispersing the resulting solution in a hydrophilic colloid.

The use of such high-boiling organic solvent has long been known for introducing hydrophobic couplers capable of producing a color image by processing with a color developing agent into a silver halide emulsion layer. Useful oils for dispersing couplers include many high-boiling organic solvents in addition to those described in the aforesaid two U.S. Patents. Such high-boiling organic solvents are described in, for example, U.S. Pat. Nos. 2,533,514, 2,835,579, Japanese Patent Publication No. 23233/71, U.S. Pat. No. 3,287,134, British Pat. No. 958,441, Japanese Patent Application (OPI) No. 1031/72 (the term "OPI" as used herein refers to a "published unexamined Japanese patent application"), British Pat. No. 1,222,753, U.S. Pat. No. 3,936,303, Japanese Patent Application (OPI) Nos. 26037/76, 82078/75, U.S. Pat. Nos. 2,353,262, 2,852,383, 3,554,755, 3,676,137, 3,676,142, 3,700,454, 3,748,141, 3,837,863, German Patent Application (OLS) No. 2,538,889, Japanese Patent Application (OPI) Nos. 27921/76, 27922/76, 26035/76, 26036/76, 62632/75, Japanese Patent Publication No. 29461/74, U.S. Pat Nos. 3,936,303, 3,748,141, Japanese Patent Application (OPI) No. 1521/78, etc.

Coupler-dispersing high-boiling organic solvents for use in conventional color photographic elements, however, often provide unsatisfactory results when used for dispersing dye-releasing redox compounds or the like which are to be used in a diffusion transfer process light-sensitive element. That is, the aforesaid non-diffusible dye-releasing redox compounds, etc., have a low solubility in organic solvents due to generally larger molecular weight and higher melting point than couplers. Therefore, the use of high-boiling solvents known to be usable in conventional color photography for dispersing dye-releasing redox compounds or the like often results in insufficient solubility, formation of unstable dispersion, or low maximum image density due to poor dye-releasing activity in association with development of silver halide.

SUMMARY OF THE INVENTION

An object of the present invention is to provide a diffusion transfer process light-sensitive element containing a high-boiling organic solvent capable of raising the maximum image density, realizing excellent dispersion stability, and thoroughly dissolving a dye-releasing redox compound.

Another object of the present invention is to provide a diffusion transfer process light-sensitive element in which a cyan image dye-releasing redox compound has a cyan-rich hue in a light-sensitive material in order to raise the light barrier effect.

The inventors have found that these objects can be attained by a color diffusion transfer process light-sensitive element comprising a support having coated thereon one or more light-sensitive silver halide emulsion layers and at least one of the silver halide emulsion layers being associated with a dye image-providing compound, with at least one of said dye image-providing compounds being dispersed in a photographic layer in a coexistent state with a liquid comprising a compound represented by the following general formula (I).

The objects of the present invention are preferably attained by dissolving a dye image-providing compound such as a dye-releasing redox compound in a solvent containing at least one high-boiling organic solvent represented by the following general formula (I), more preferably in only an organic solvent of the general formula (I), and dispersing the resulting solution in a hydrophilic colloid:

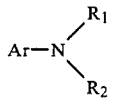

(I)

wherein $R_1$ represents a substituted or unsubstituted alkyl, aralkyl, cycloalkyl or alkenyl group, $R_2$ represents a hydrogen atom or the same substituent as defined for $R_1$, Ar represents an unsubstituted phenyl group, a methylenedioxyphenyl group, or a phenyl or naphthyl group substituted by a halogen atom, a carboxy group or a substituted or unsubstituted alkyl, aralkyl, alkenyl, cycloalkyl, alkylthio, phenyl, alkoxy, aryloxy, alkylamino, acylamino, carbamoyl, sulfonamido or sulfamoyl group, with the phenyl or naphthyl group being optionally substituted by two or more, same or different, substituents in two or more positions, or $R_1$ and $R_2$ may be connected to each other to form a ring, or either $R_1$ or $R_2$ may be connected to ring Ar to form a fused ring.

DETAILED DESCRIPTION OF THE INVENTION

Of the compounds represented by the general formula (I), preferable compounds are those represented by the following general formula (II) or (III), with those represented by the general formula (II) being more preferable:

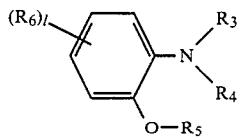

(II)

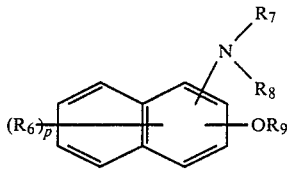

(III)

wherein $R_3$, $R_4$, $R_5$, $R_7$, $R_8$ and $R_9$, which may be the same or different, each represents a substituted or unsubstituted alkyl, alkenyl, cycloalkyl or aralkyl group, $R_6$ represents a hydrogen atom, a halogen atom, or a substituted or unsubstituted alkyl, aralkyl, alkenyl, cycloalkyl, alkylamino, alkylthio, phenyl or aryloxy group, with

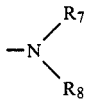

and —O—$R_9$ being in an o-position with each other, l represents 0 or an integer of 1 to 4, p represents 0 or an integer of 1 to 6 and, when two or more $R_6$'s exist in one and the same molecule, they may be different from each other.

Substituents represented by $R_3$ to $R_9$ in the general formula (II) or (III) will be described in more detail below. The unsubstituted alkyl group represented by $R_3$, $R_4$, $R_5$, $R_7$, $R_8$ or $R_9$ includes straight and branched chain alkyl groups containing 1 to 24 carbon atoms such as a methyl group, an ethyl group, a butyl group, an isobutyl group, a pentyl group, a t-butyl group, an isopropyl group, a hexyl group, a 2-ethylhexyl group, an octyl group, a dodecyl group, a t-octyl group, a hexadecyl group, etc. The unsubstituted alkenyl group includes alkenyl groups containing 3 to 24 carbon atoms such as an allyl group, a 2,4-pentadienyl group, etc. The unsubstituted cycloalkyl group includes cycloalkyl groups containing 5 to 24 carbon atoms such as a cyclopentyl group, a cyclohexyl group, etc. The unsubstituted aralkyl group includes aralkyl groups containing 7 to 24 carbon atoms such as a benzyl group, a phenylethyl group, etc. The substituted alkyl, alkenyl, cycloalkyl or aralkyl group represented by $R_3$, $R_4$, $R_5$, $R_7$, $R_8$ or $R_9$ includes those of the above-described unsubstituted alkyl, alkenyl, cycloalkyl or aralkyl groups substituted in a suitable position or positions by hydroxy group, alkyox group containing 1 to 16 carbon atoms, aryl group, acylamino group, sulfonamido group, aryloxy group, alkylthio group, carbamoyl group, sulfamoyl group, sulfonyl group, cyano group, halogen atom, carboxyl group, alkylamino group, alkoxycarbonyl group, acyl group or acyloxy group.

To describe $R_6$ in more detail, $R_6$ represents a hydrogen atom, a halogen atom (e.g., a fluorine atom, a chlorine atom, etc.), or the same substituted or unsubstituted alkyl, aralkyl, alkenyl or cycloalkyl group as defined for the foregoing $R_3$, $R_4$, $R_5$, $R_7$, $R_8$ and $R_9$. As the alkyl group, branched chain alkyl groups containing 4 to 24 carbon atoms (for example, a t-butyl group, a t-octyl group, a 2-ethylhexyl group, etc.) are preferable. $R_6$ further represents a substituted or unsubstituted alkylamino group (e.g., an N,N-diethylamino group, a t-butylamino group, a cyclohexylamino group, an n-octylamino group, a t-octylamino group, an N,N-di-n-octylamino group, a 2-hydroxyethylamino group, etc.), a substituted or unsubstituted alkylthio group (e.g., an octylthio group, a dodecylthio group, a benzylthio group, a 3-(2,4-dimethylphenyl)propylthio group, etc.), a substituted or unsubstituted phenyl group (e.g., a phenyl group, a 2-methylphenyl group, a

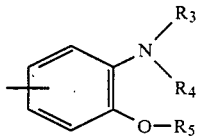

group, etc.) or a substituted or unsubstituted aryloxy group (e.g., a phenoxy group, a 2,4-dimethylphenoxy group, a

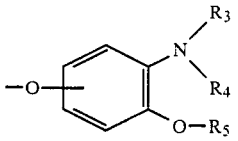

group, etc.).

Further, of the compounds represented by the general formula (II), those wherein the sum of the carbon atoms contained in $R_3$, $R_4$, $R_5$ and $R_6$ is 13 or more are preferable and, of the compounds represented by the general formula (III), those wherein the sum of the carbon atoms contained in $R_6$, $R_7$, $R_8$ and $R_9$ is 10 or more are preferable.

Compounds included in the general formula (I) are illustrated below which, however, do not limit the present invention in any way in view of attaining the objects of the present invention. Alkyl groups in the following illustrative compounds are normal (n) alkyl groups unless otherwise specified.

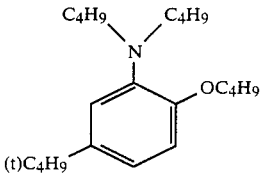

Compound 1

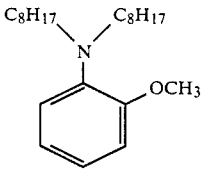

Compound 2

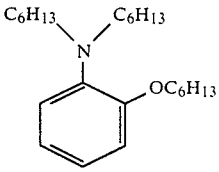

Compound 3

-continued
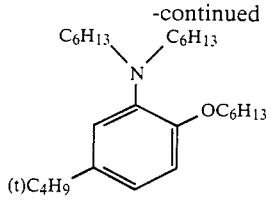
Compound 4
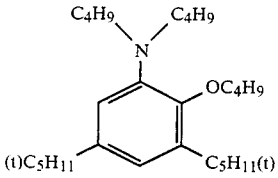
Compound 5
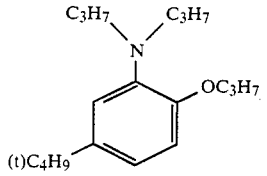
Compound 6
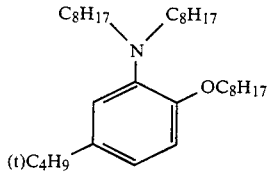
Compound 7
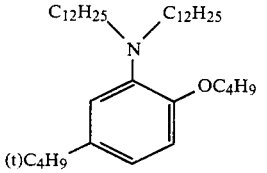
Compound 8
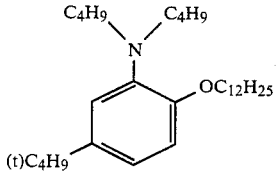
Compound 9
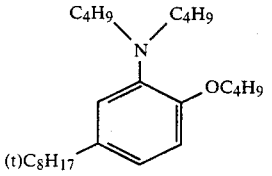
Compound 10
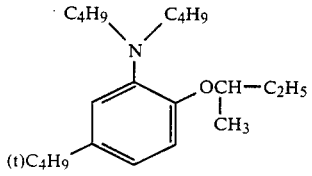
Compound 11
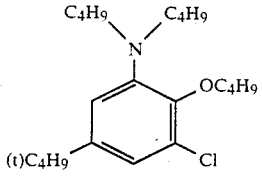
Compound 12
-continued
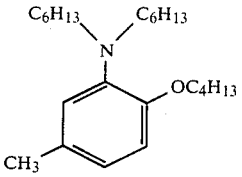
Compound 13
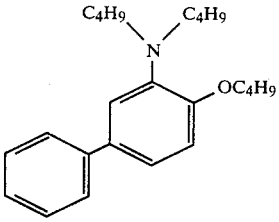
Compound 14
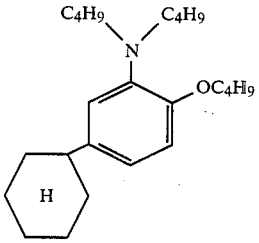
Compound 15
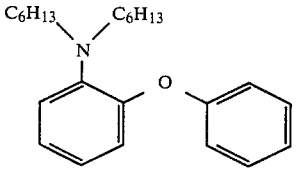
Compound 16
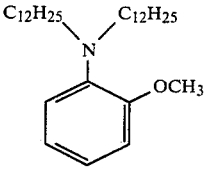
Compound 17
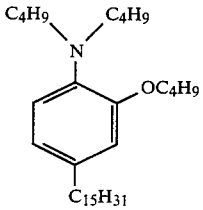
Compound 18
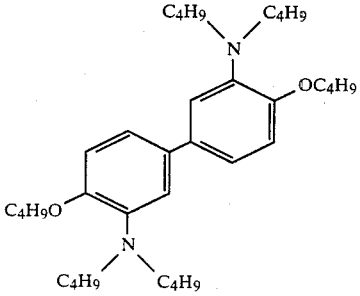
Compound 19

-continued
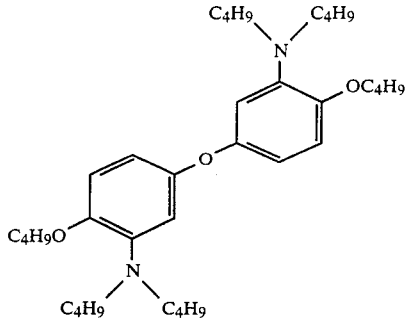
Compound 20
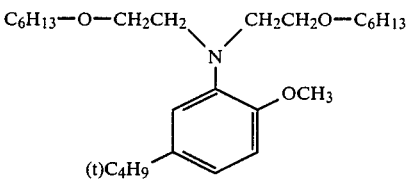
Compound 21
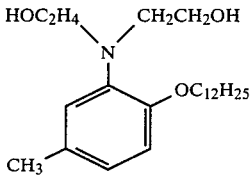
Compound 22
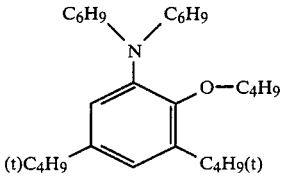
Compound 23
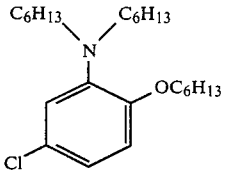
Compound 24
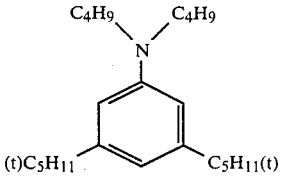
Compound 25
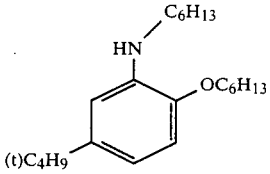
Compound 26
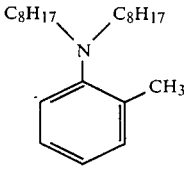
Compound 27
-continued
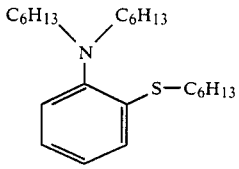
Compound 28
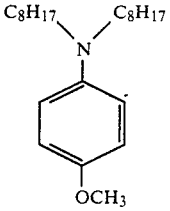
Compound 29
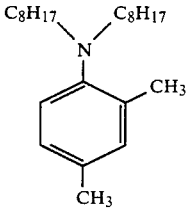
Compound 30
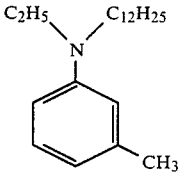
Compound 31
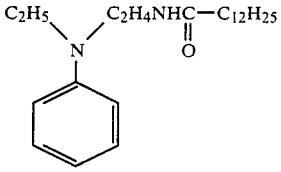
Compound 32
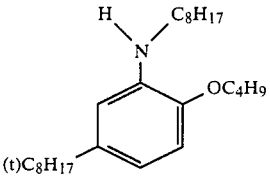
Compound 33
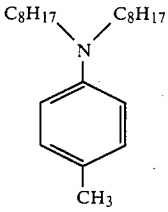
Compound 34
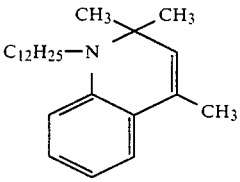
Compound 35

-continued

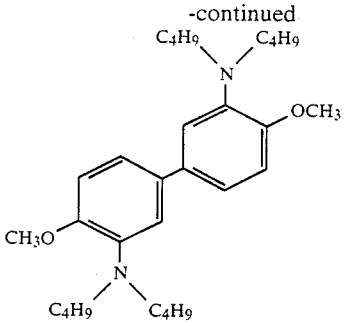

Compound 36

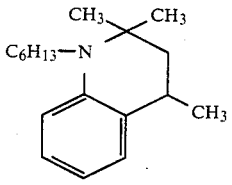

Compound 37

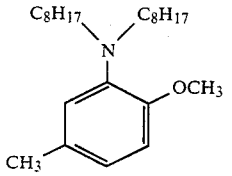

Compound 38

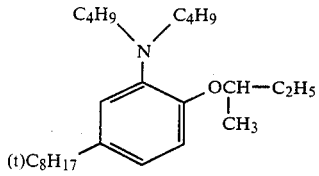

Compound 39

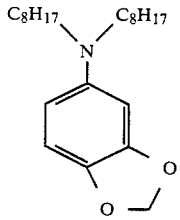

Compound 40

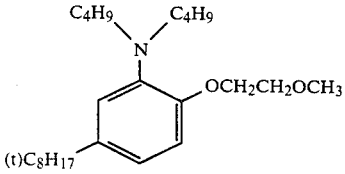

Compound 41

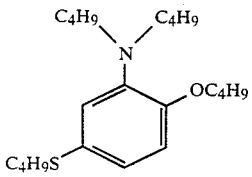

Compound 42

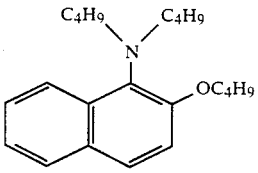

Compound 43

-continued

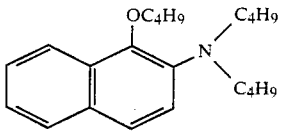

Compound 44

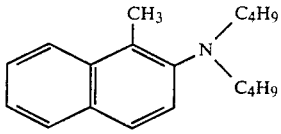

Compound 45

Compounds represented by the general formulae (I), (II) and (III) are known by U.S. Pat. No. 3,336,135 granted to Terashima et al. and Japanese Patent Application (OPI) No. 11453/81 (Okaniwa et al.). However, the inventions disclosed therein are completely different from the present invention in construction and effect. That is, the two patent documents do not describe dye-releasing redox compounds, and they disclose only the effect of improving light stability or dark heat stability by the combination of a conventional coupler and a color-developing agent. U.S. Pat. No. 3,336,135 describes a combination of an azomethine or indoaniline dye to obtain the effect of preventing fading by light. Japanese Patent Application (OPI) No. 11453/81 describes a combination of a cyan dye formed from a phenolic or naphtholic cyan coupler to obtain the effect of preventing dark heat fading. On the other hand, many dye image-providing compounds such as dye-releasing redox compounds to be used in the present invention have an azo dye residue in the dye moiety thereof as is different from those described in the above-described patent or patent application, and are compounds capable of releasing a diffusible, image-forming dye associated with the development of silver halide and, usually, they themselves do not become image-forming dyes. Therefore, light or heat stability is not an important factor with them.

As is described above, the effect of the present invention to improve maximum image density, etc., was never expected based on conventional knowledge.

The light-sensitive silver halide emulsion to be used in the present invention is a hydrophilic colloidal dispersion of silver chloride, silver bromide, silver chlorobromide, silver iodobromide, silver chlorobromoiodide, or the mixtures thereof. The halide composition is selected depending upon the end-use and processing conditions of the light-sensitive materials. In particular, silver bromide, silver bromoiodide or silver chlorobromoiodide containing not more than 10 mol% iodide and not more than 30 mol% chloride is preferable.

Both negative type emulsions forming surface latent image and direct reversal type emulsions can be used in the present invention. As the latter emulsions, there are internal latent image-forming emulsions and previously fogged direct reversal type emulsions.

In the present invention, internal latent image-forming silver halide emulsions can be advantageously used. Examples of this type emulsions include conversion type emulsions, core/shell type emulsions, emulsions containing a foreign metal, etc., described in U.S. Pat. Nos. 2,592,250, 3,206,313, 3,447,927, 3,761,276, 3,935,014, etc.

Typical examples of the nucleating agents to be used in this type emulsions include hydrazines described in U.S. Pat. Nos. 2,588,982 and 2,563,785; hydrazides and hydrazones described in U.S. Pat. No. 3,227,552; quaternary salt compounds described in British Pat. No. 1,283,835, Japanese Patent Publication No. 38164/74, U.S. Pat. Nos. 4,115,122, 3,734,738, 3,719,494 and 3,615,615; sensitizing dyes having a nucleating substituent in the dye molecule and described in U.S. Pat. No. 3,718,470; thiourea-connected acylhydrazine compounds described in U.S. Pat. Nos. 4,030,925, 4,031,127, 4,245,037, 4,255,511, 4,266,013, 4,276,364, etc.; etc.

The silver halide emulsion to be used in the present invention may have, if desired, a light sensitivity expanded by a spectrally sensitizing dye. As such spectrally sensitizing dyes, cyanine dyes and merocyanine dyes can properly be used.

The dye image-providing compound to be used in the present invention is of negative or positive type as is known to those skilled in the art and, when processed with an alkaline processing composition, is initially either mobile or immobile in a photographic element.

As examples of negative type dye image-providing compounds useful in the present invention, there are couplers which react with an oxidized product of a color developing agent to form or release a dye. Specific examples thereof are described in U.S. Pat. No. 3,227,550, Canadian Pat. No. 602,207, etc.

Examples of the negative type dye image-providing compounds to be preferably used in the present invention include dye-releasing redox compounds which react with a developing agent in an oxidized state or an electron-transferring agent to release a dye. Typical examples thereof are described in Japanese Patent Application (OPI) Nos. 33826/73, 54021/79, 113624/76, 71072/81, etc. Examples of the immobile positive type dye image-providing compounds to be used in the present invention include those compounds which release a diffusible dye during photographic processing under alkaline conditions without accepting electrons (i.e., without being reduced) or after accepting at least one electron (i.e., after being reduced).

Furthermore, as positive type dye image-providing compounds which are mobile from the first in an alkaline photographic processing conditions and are effective in the present invention, there are dye developers typical specific examples of which are described in Japanese Patent Publication Nos. 32130/73, 22780/80, etc.

The dyes to be formed from the dye image-providing compounds and to be used in the present invention may be either complete dyes or dye precursors capable of being converted to dyes in a photographic processing step or in an additional processing stage. Final image dyes may be either metallized or not. As the typical dye structure useful for the present invention, there are illustrated metallized or non-metallized azo dyes, azo methine dyes, anthraquinone dyes, and phthalocyanine dyes. Of these, azo type cyan, magenta and yellow dyes are of particular importance.

Specific examples of yellow dye image-providing compounds usable in the present invention are described in Japanese Patent Publication No. 2618/74, U.S. Pat. No. 3,309,199, Japanese Patent Publication No. 12140/82, Japanese Patent Application (OPI) Nos. 114930/76, 111344/79, 16130/81, 71072/81, 79031/79, 64036/78 and 23527/79, U.S. Pat. Nos. 4,148,641 and 4,148,643, *Research Disclosure,* 17630 (1978) and ibid., 16475 (1977).

Specific examples of magenta dye image-providing compounds are described in U.S. Pat. No. 3,453,107, Japanese Patent Publication No. 43950/71, Japanese Patent Application (OPI) No. 106727/77, U.S. Pat. Nos. 3,932,380, 3,931,144 and 3,932,308, Japanese Patent Application (OPI) Nos. 115528/75, 106727/77, 23628/78, 65034/79, 36804/80, 161332/79, 4028/80, 73057/81, 71060/81, 134/80 and 35533/78, U.S. Pat. Nos. 4,207,104 and 4,287,292.

Further, specific examples of cyan dye image-providing compounds are described in Japanese Patent Publication No. 32130/73, Japanese Patent Application (OPI) Nos. 8827/77, 126331/74, 109928/76, 99431/79, 149328/78, 47823/78, 143323/78, 71061/81, 64035/78, 121125/79, U.S. Pat. Nos. 4,142,891, 4,195,994, 4,147,544, 4,148,642, European Pat. Nos. 53,037 and 53,040, *Research Disclosure,* 17630 (1978), ibid., 16475 (1975), and ibid., 16475 (1977).

In addition, dye-releasing redox compounds having a dye moiety whose light absorption is temporarily shifted in a light-sensitive element can also be used as a kind of dye precursors. Specific examples thereof are described in Japanese Patent Application (OPI) Nos. 53330/80 and 53329/80, U.S. Pat. Nos. 3,336,287, 3,579,334 and 3,982,946 and British Pat. No. 1,467,317.

Dye image-providing compounds preferably used in the present invention are those which are immobile under alkaline processing conditions and are generally represented by the following formula:

(Ballast)-(Link)-(Dye) (IV)

wherein (Ballast) represents a ballast group for immobilizing the compounds under alkaline processing conditions, (Dye) represents a dye group mobile through a light-sensitive element at least under alkaline processing conditions or a precursor thereof, and (Link) represents a redox-cleavage group which undergoes cleavage by oxidation upon development or underoges, to the contrary, depression of cleavage.

As dye image-providing compounds particularly preferably used in the present invention, there are first illustrated dye-releasing redox compounds (DRR compounds). Specific examples thereof are described in the foregoing Japanese Patent Application (OPI) Nos. 54021/79, 71072/81, and U.S. Pat. Nos. 3,928,312 (USB 351,673) and 4,055,428, etc. Specific examples of (Ballast)-(Link)-releasing a diffusible dye under alkaline conditions upon development of silver halide are as follows:

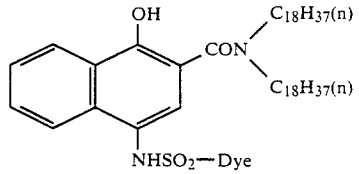

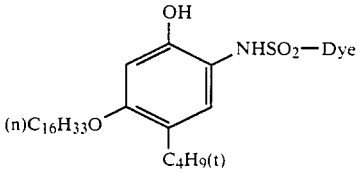

As the other type particularly preferable dye image-providing compounds, there are positive type ones described in Japanese Patent Application (OPI) No. 164342/81 and U.S. Pat. Nos. 4,139,379 and 4,139,389. Specific examples of (Ballast)-(Link)-are as follows:

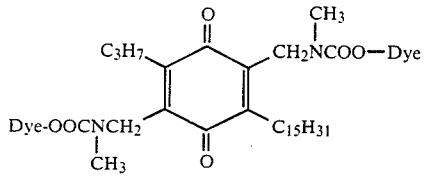

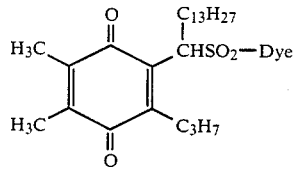

Preferable dye image-providing compounds to be used in the present invention are compounds having an azonaphthol dye moiety having a nitro group-substituted phenyl group, more preferably, dye image-providing compounds of the foregoing general formula (IV) having a structure represented by the following general formula (V):

(V)

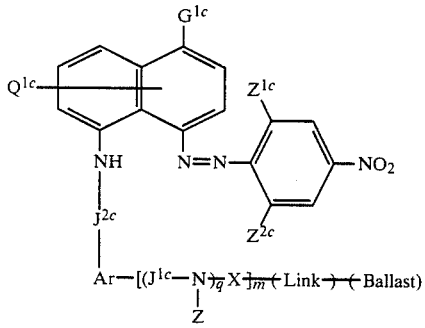

wherein:

$Q^{1c}$ is connected to either of the naphthol nucleus rings and represents a hydrogen atom, a halogen atom, a sulfamoyl group represented by $-SO_2NY^{3c}Y^{4c}$ (wherein $Y^{3c}$ represents a hydrogen atom, an alkyl group or a substituted alkyl group, $Y^{4c}$ represents a hydrogen atom or $Y^{4ac}$, $Y^{4ac}$ represents an alkyl group, a substituted alkyl group, an aralkyl group or an aryl group, or $Y^{3c}$ and $Y^{4c}$ may be connected to each other directly or via an oxygen atom to form a ring), $-SO_2Y^{5c}$ (wherein $Y^{5c}$ represents an alkyl group, a substituted alkyl group or a benzyl group), a carboxyl group, $-COOY^{6c}$ (wherein $Y^{6c}$ represents an alkyl group, a substituted alkyl group, a phenyl group or a substituted phenyl group) or $-CONY^{3c}Y^{4c}$ (wherein $Y^{3c}$ and $Y^{4c}$ are the same as defined above);

$J^{2c}$ represents $-SO_2-$ or $-CO-$;

Ar represents a phenylene group or a substituted phenylene group;

$Z^{1c}$ represents a halogen atom, a cyano group, a nitro group, a trifluoromethyl group, an alkyl group, an alkoxy group, a carboxyl group, a carboxylic acid ester group represented by $-COOY^{6c}$ (wherein $Y^{6c}$ is the same as defined above), a fluorosulfonyl group, a phenoxysulfonyl group, a substituted phenoxysulfonyl group, a sulfamoyl group represented by $-SO_2NY^{3c}Y^{4c}$ (wherein $Y^{3c}$ and $Y^{4c}$ are the same as defined above), a carbamoyl group represented by $-CONY^{3c}Y^{4c}$ (wherein $Y^{3c}$ and $Y^{4c}$ are the same as defined above), an alkylsulfonyl group, a substituted alkylsulfonyl group, a phenylsulfonyl group or a substituted phenylsulfonyl group;

$Z^{2c}$ represents a hydrogen atom, a halogen atom, a nitro group, a cyano group or a trifluoromethyl group;

$J^{1c}$ represents $-SO_2-$ or $-CO-$;

Z represents a hydrogen atom, an alkyl group or a substituted alkyl group;

X represents a divalent linking group represented by $-A_1-(L)_l-(A_2)_p-$ (wherein $A_1$ and $A_2$, which may be the same or different, each represents an alkylene group or an arylene group, L represents a divalent group selected from the group consisting of oxy, carbonyl, carboxyamido, carbamoyl, sulfonamido, sulfamoyl, sulfinyl, sulfonyl and a mixture thereof, and l and p each represents 0 or 1);

m and q each represents 0 or 1;

$G^{1c}$ represents a hydroxy group or a group capable of providing a hydroxy group by hydrolysis; and (Link) and (Ballast) are the same as defined with respect to the general formula (IV).

The combination of a dye image-providing compound represented by the general formula (V) and a solvent represented by the general formula (I) makes it possible to shift the absorption spectrum of the dye image-providing compound to cyan in a light-sensitive element, which is desirable as a photographic element in view of light barriers.

Of the dye image-providing compounds represented by the general formula (V), naphtholazo compounds represented by the following general formula (VI) are preferable:

(VI)

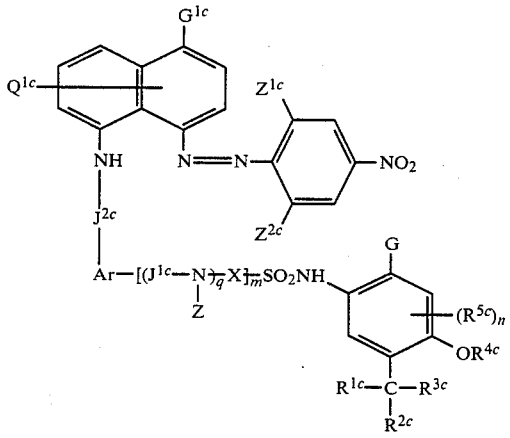

wherein:

G represents a hydroxy group or a group capable of providing a hydroxy group by hydrolysis;

$R^{1c}$ and $R^{2c}$, which may be the same or different, each represents an alkyl group or an aromatic group, or $R^{1c}$ and $R^{2c}$ may be connected to each other to form a ring;

$R^{3c}$ represents a hydrogen atom, an alkyl group or an aromatic group;

$R^{4c}$ represents an alkyl group or an aromatic group;

$R^{5c}$ represents an alkyl group, an alkoxy group, an alkylthio group, an arylthio group, a halogen atom or an acylamino group;

n represents 0, 1 or 2;

$R^{4c}$ and $R^{5c}$ may be connected to each other to form a fused ring;

$R^{1c}$ and $R^{4c}$ may be connected to each other to form a fused ring;

$R^{1c}$ and $R^{5c}$ may be connected to each other to form a fused ring;

the sum of the carbon atoms contained in $R^{1c}$, $R^{2c}$, $R^{3c}$, $R^{4c}$ and $(R^{5c})_n$ is more than 7; and $Q^{1c}$, $J^{2c}$, Ar, $Z^{1c}$, $Z^{2c}$, $J^{1c}$, Z, X, m, q and $G^{1c}$ are the same as defined with respect to the general formula (V).

As the compounds containing an azonaphthol dye moiety having a nitro group-substituted phenyl group, those represented by the following general formula are preferable:

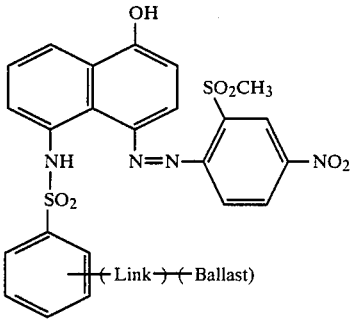

wherein (Link) and (Ballast) are the same as defined with the general formula (IV).

Specific examples thereof include Compounds C-5 to C-18 as described hereinafter.

Preferable cyan dye-providing compounds are described in Japanese Patent Application (OPI) Nos. 126331/74, 109928/76, 99431/79, 71061/81, etc., with those described in Japanese Patent Application (OPI) No. 71061/81 being particularly preferable.

Specific examples of the cyan dye-releasing redox compounds represented by the foregoing general formula (VI) are illustrated below:

Compound C-1

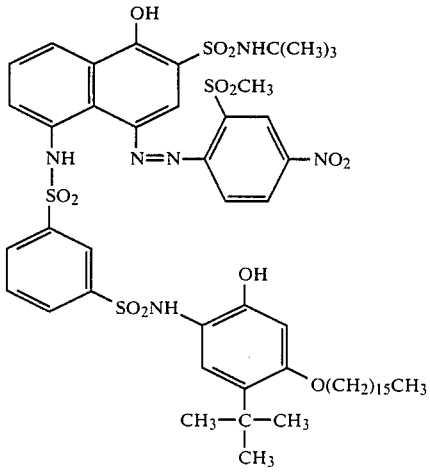

-continued

Compound C-2

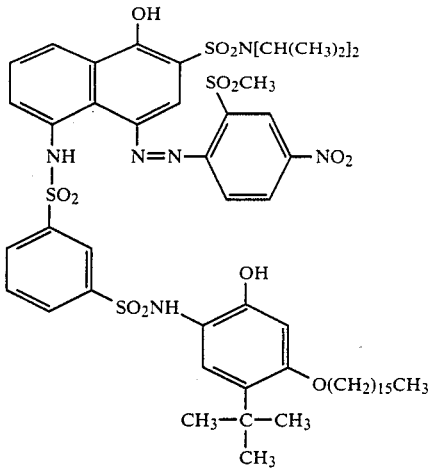

Compound C-3

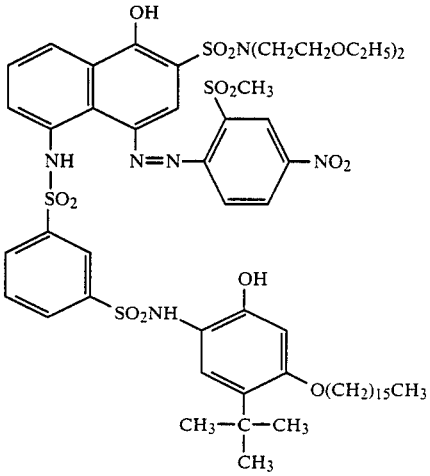

Compound C-4

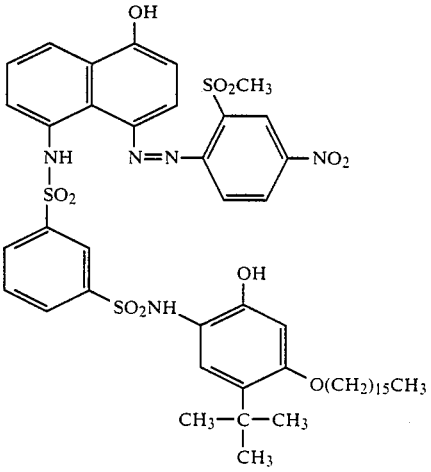

-continued

Compound C-5

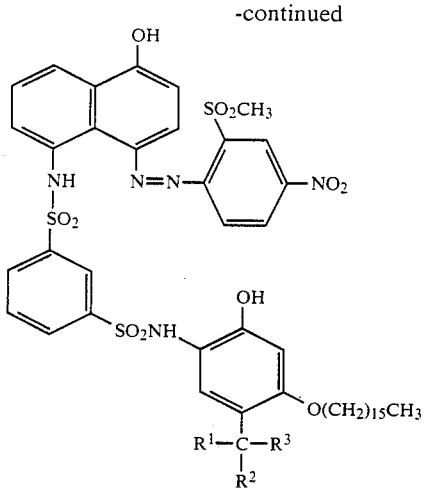

(wherein $R^1 = R^2 = CH_3$, $R^3 = C_6H_5$)

Compound C-6
represented by the formula of Compound C-5 wherein $R^1=R^2=CH_3$, and $R^3=C_2H_5$ Compound C-7
represented by the formula of Compound C-5 wherein $R^1=R^2=CH_3$, and $R^3=CH_2—C(CH_3)_3$ Compound C-8
represented by the formula of Compound C-5 wherein $R^1=CH_3$, $R^2=C_2H_5$, and $R^3=C_4H_9$-n Compound C-9
represented by the formula of Compound C-5 wherein $R^1=R^2=CH_3$, and $R^3=H$ Compound C-10
represented by the formula of Compound C-5 wherein $R^1+R^2=—(CH_2)_5—$, and $R^3=H$ Compound C-11

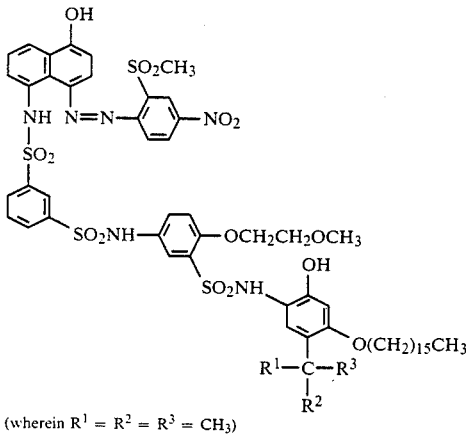

(wherein $R^1 = R^2 = R^3 = CH_3$)

Compound C-12
represented by the formula of Compound C-11 wherein $R^1=R^2=CH_3$, and $R^3=C_2H_5$ Compound C-13
represented by the formula of Compound C-11 wherein $R^1=R^2=CH_3$, and $R^3=—(CH_2)—C(CH_3)_3$ Compound C-14
represented by the formula of Compound C-11 wherein $R^1=CH_3$, $R^2=C_2H_5$, and $R^3=C_4H_9$-n Compound C-15
represented by the formula of Compound C-11 wherein $R^1=R^2=CH_3$, and $R^3=H$ Compound C-16
represented by the formula of Compound C-11 wherein $R^1+R^2=—(CH_2)_5—$, and $R^3=H$ Compound C-17

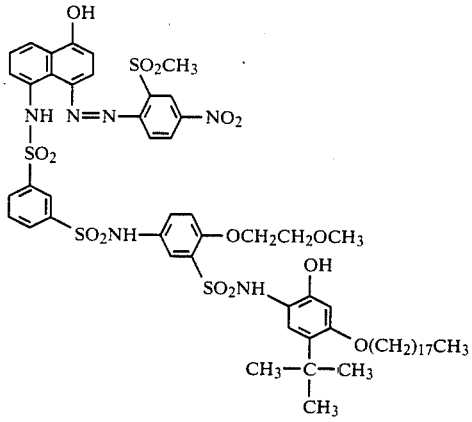

Compound C-18

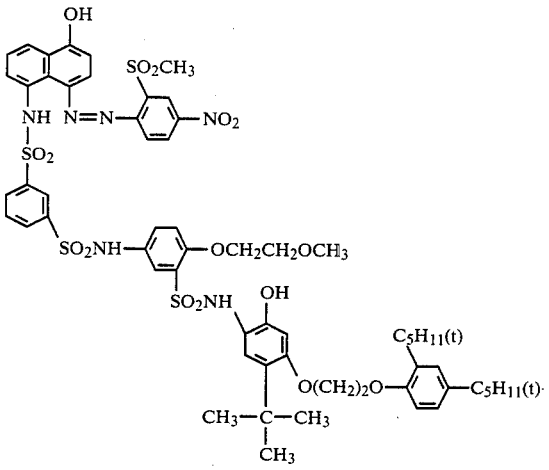

As preferable dye image-providing compounds to be used in combination with the compounds of the present invention represented by the general formula (I), there are illustrated positive type redox nucleus-containing compounds described in the foregoing Japanese Patent Application (OPI) Nos. 110828/78, 110827/78, 111628/74, 4819/77, 63618/76, 130927/79, 164342/81, etc. Of these, particularly preferable ones are those compounds which have a redox carrier moiety represented by the following general formula (VII):

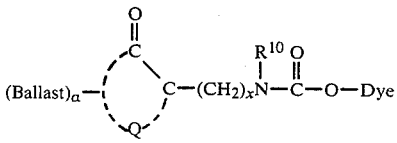

(VII)

wherein (Ballast) is the same as defined with the general formula (IV), Q represents a quinone nucleus (including that containing various substituents), x represents an integer of 1 or 2, $R^{10}$ represents an alkyl or substituted alkyl group containing 1 to about 40 carbon atoms or an aryl or substituted aryl group containing 6 to 40 carbon atoms, α represents 0 or 1 and, when $R^{10}$ represents a group containing not more than 8 carbon atoms, α represents 1. The compounds represented by the general formula (VII) include those of the following formula:

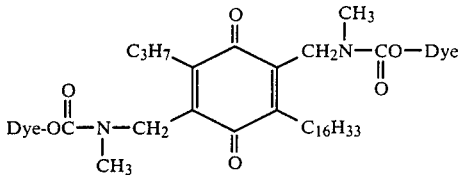

More specific examples are described in the aforesaid Japanese Patent Application (OPI) No. 110827/78.

The following descriptions will be given by reference to a typical case of using dye-releasing redox compound. Needless to say, the same descriptions apply when using other dye image-providing compounds.

The dye-releasing redox compound to be used in the present invention can be dispersed in a hydrophilic colloid solution by dissolving it in a solution containing at least one organic solvent represented by the general formula (I) and adding the resulting solution to a hydrophilic colloid solution. In this occasion, the organic solvent represented by the general formula (I) may be used in combination with an organic solvent having a boiling point of about 30° to 150° C. described in the aforementioned U.S. Pat. No. 2,322,027, etc., and a high-boiling organic solvent (having a boiling point of 180° C. or above and described in the same patent) or with an oleophilic polymer as described in U.S. Pat. No. 3,619,195, West German Pat. No. 1,957,467 and West German Patent Application (OLS) No. 3,108,198. In addition, the dye-releasing redox compound may be dissolved in a mixture of at least one organic solvent represented by the general formula (I) and a water-miscible solvent and adding to this solution an aqueous latex to obtain a dispersion wherein the dye-releasing redox compound is contained in latex particles together with the organic solvent of the present invention. This technique is described in, for example, Japanese Patent Application (OPI) No. 59943/76 and Japanese Patent Publication No. 39853/76.

A particularly preferable embodiment is to use as a solvent for the dye-releasing redox compound a solvent containing 50 wt% or more (more preferably 90 to 100 wt%) of a compound represented by the general formula (I).

Use of a surface active agent as an emulsification aid remarkably serves to disperse the dye-releasing redox compound. Useful surface active agents are described in, for example, the aforesaid patents and Japanese Patent Publication No. 4923/64 and U.S. Pat. No. 3,676,141.

As the hydrophilic colloids to be used for dispersing the dye-releasing redox compound to be used in the present invention, there are illustrated, for example, gelatin, colloidal albumin, casein, cellulose derivatives (e.g., carboxymethyl cellulose, hydroxyethyl cellulose, etc.), sugar derivatives (e.g., agar-agar, sodium alginate, starch derivative, etc.), synthetic hydrophilic colloids (e.g., polyvinyl alcohol, poly-N-vinyl pyrrolidone, polyacrylic acid copolymer, polyacrylamide, the derivative thereof (e.g., partially hydrolyzed product, etc.), etc.), and the like. If desired, a compatible mixture of two or more of these colloids may be used. Of these, gelatin is most popularly used. Gelatin may be replaced, partly or wholly, by a synthetic hydrophilic colloid.

The dye-releasing redox compound is coated in an amount of $1\times10^{-4}$ to $1\times10^{-2}$ mol/m$^2$, preferably $2\times10^{-4}$ to $2\times10^{-3}$ mol/m$^2$.

The amount of the solvent represented by the general formula (I) based on the dye image-providing compound is desirably 5 mol% to 500 mol%, particularly desirably 10 mol% to 300 mol%, more preferably 50 mol% to 200 mol%.

In the above-described process, any silver halide-developing agent can be used that can cross-oxidize the dye-releasing redox compound. Such developing agent may be incorporated in an alkaline processing composition or in a proper layer of a photographic element. Examples of the developing agent usable in the present invention include hydroquinones, aminophenols, phenylenediamines, pyrazolidinones (e.g., phenidone, 1-phenyl-3-pyrazolidinone, dimezone (or 1-phenyl-4,4-dimethyl-3-pyrazolidinone), 1-p-tolyl-4-methyl-4-hydroxymethyl-3-pyrazolidinone, 1-(4'-methoxyphenyl)-4-methyl-4-hydroxymethyl-3-pyrazolidinone, 1-phenyl-4-methyl-4-hydroxymethyl-3-pyrazolidinone, etc.), described in Japanese Patent Application (OPI) No. 16131/81, and the like.

Of these illustrated above, black-and-white developing agents capable of depressing formation of stain in an image-receiving layer (particularly pyrazolidinones) are generally more preferable than color-developing agents such as phenylenediamines.

The processing composition to be used for processing a photographic light-sensitive material of the present invention contains a base such as sodium hydroxide, potassium hydroxide, sodium carbonate or sodium phosphate and suitably has a pH of about 9 or more, preferably 11.5 or more. The processing composition may contain an antioxidant such as sodium sulfite, ascorbic acid salt or piperidinohexose reductone and may contain a silver ion concentration-adjusting agent such as potassium bromide. In addition, a viscosity-increasing compound such as hydroxyethyl cellulose or sodium carboxymethyl cellulose may be incorporated.

The alkaline processing composition may further contain a compound which accelerates development or dye diffusion such as benzyl alcohol.

In reproducing natural color according to subtractive color photography, a light-sensitive material is used which comprises at least two combinations of an emulsion having a selective spectral sensitivity in a certain wavelength region and a dye image-providing compound having a selective spectral absorption in the same wavelength region.

In particular, a light-sensitive material comprising a combination of a blue-sensitive silver halide emulsion and a yellow dye-releasing redox compound, a combination of a green-sensitive silver halide emulsion and a magenta dye-releasing redox compound, and a combination of a red-sensitive silver halide emulsion and a cyan dye-releasing redox compound is useful. These combination units of emulsion and dye-releasing redox compound may be coated in layers in a face-to-face relation in a light-sensitive material or may be coated as a single layer by forming and mixing particles of respective combinations (wherein the dye-releasing redox compound and silver halide grains exist in the same particles).

Scavengers for an oxidized developing agent may be used in various interlayers of the photographic element of the present invention. Suitable substances are described in *Research Disclosure*, Vol. 151, pp. 76 to 79 (November 1976).

A spacer layer may be provided between an interlayer and a layer containing dye image-providing compound as described in Japanese Patent Application (OPI) No. 52056/80. In addition, a silver halide emulsion may be added to an interlayer as described in Japanese Patent Application (OPI) No. 67850/81.

As to mordant layers, neutralizing layers, neutralization rate-adjusting layers (timing layers), processing compositions, etc., to be used in the color diffusion transfer process light-sensitive material of the present invention, those described in, for example, Japanese Patent Application (OPI) No. 64533/77 can be used.

Polymer mordants to be used in the present invention include secondary and tertiary amino group-containing polymers, polymers having nitrogen-containing hetero rings, polymers having quaternary cation groups thereof, etc., having a molecular weight of 5,000 or more, particularly preferably 10,000 or more.

For example, there are illustrated vinylpyridine polymers and vinylpyridinium cation polymers described in U.S. Pat. Nos. 2,548,564, 2,484,430, 3,148,061, 3,756,814, etc.; vinylimidazolium cation polymers described in U.S. Pat. No. 4,124,386; polymer mordants capable of cross-linking with gelatin or the like disclosed in U.S. Pat. Nos. 3,625,694, 3,859,096, 4,128,538, British Pat. No. 1,277,453, etc.; aqueous sol-type mordants disclosed in U.S. Pat. Nos. 3,958,995, 2,721,852, 2,798,063, Japanese Patent Application (OPI) Nos. 115228/79, 145529/79, 126027/79, 155835/79, 17352/81, etc.; water-insoluble mordants disclosed in U.S. Pat. No. 3,898,088; reactive mordants capable of forming covelent bond with a dye, disclosed in U.S. Pat. Nos. 4,168,976, 4,201,840, etc.; and mordants disclosed in U.S. Pat. Nos. 3,709,690, 3,788,855, 3,642,482, 3,488,706, 3,557,066, 3,271,147, 3,271,148, Japanese Patent Application (OPI) Nos. 30328/78, 155528/77, 125/78, 1024/78, 107835/78, British Pat. No. 2,064,802, etc.

Further, there are those mordants which are described in U.S. Pat. Nos. 2,675,316 and 2,882,156.

As an image-receiving layer which mordants an azo dye having a chelating group, those in which a polymer capable of immobilizing a transition metal ion and a transition metal ion are incorporated in a mordanting layer or in an adjacent layer are preferable. Examples of the polymer capable of immobilizing a transition metal ion are described in Japanese Patent Application (OPI) Nos. 48210/80, 129346/80, U.S. Pat. Nos. 4,273,853 and 4,282,305.

In adapting the light-sensitive material of the present invention to color diffusion transfer process, there can be formed film units of peel-apart type structure, integrated structure as described in Japanese Patent Publication Nos. 16356/71, 33697/73, Japanese Patent Application (OPI) No. 13040/75, and British Pat. No. 1,330,524, and delamination-free structure as described in Japanese Patent Application (OPI) No. 119345/82.

In every type format described above, the use of a welding latex polymer layer disclosed in Japanese Patent Application (OPI) Nos. 145217/77, 72622/78, 78130/79, 138432/79, and 138433/79 or a polymer acid layer protected by a temporary barrier layer capable of shortening neutralization timing time at high processing temperatures, such as lactone ring-containing polymers disclosed in Japanese Patent Application (OPI) No. 54341/80 and *Research Disclosure*, 18425 (1979) is advantageous in view of expanding an allowable processing temperature range.

The present invention will now be described in more detail by reference to the following specific examples.

EXAMPLE 1

On a transparent polyester support were coated, in sequence, the following layers to prepare light-sensitive sheets.

(1) A mordant layer containing poly(vinylbenzylmethylpiperidinium chloride-co-styrene-co-divinylbenzene) (3.0 g/m$^2$) and gelatin (3.0 g/m$^2$).

(2) A white reflecting layer containing titanium dioxide (20 g/m$^2$) and gelatin (2.0 g/m$^2$).

(3) A light barrier layer containing carbon black (1.36 g/m$^2$) and gelatin (1.00 g/m$^2$).

(4) A layer containing the following DRR compound (0.40 g/m$^2$), each of five solvents of the present invention given in Table 1 (0.33 mmol/m$^2$), 2,5-di(t-pentadecyl)hydroquinone (0.01 g/m$^2$), and gelatin (0.8 g/m$^2$).

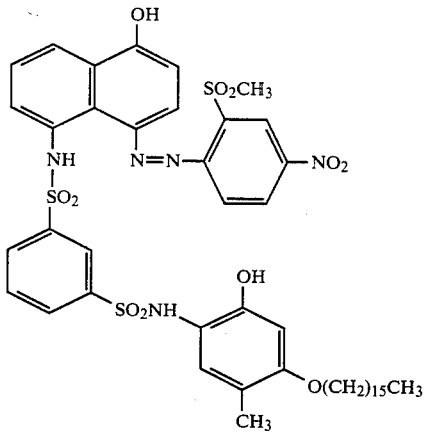

(5) A layer containing a red-sensitive, internal latent image-forming, direct reversal silver bromide emulsion (1.03 g/m$^2$ of silver), gelatin (1.2 g/m$^2$), a nucleating agent of the following structure (0.05 mg/m$^2$), and sodium pentadecylhydroquinonesulfonate (0.13 g/m$^2$),

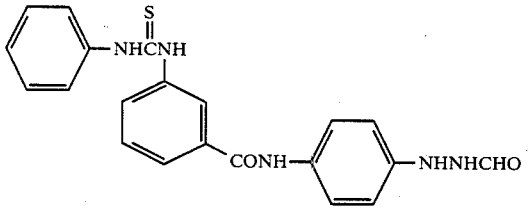

(6) A layer containing 2,5-di(tert-pentadecyl)hydroquinone (0.71 g/m$^2$), a vinylpyrrolidone/vinyl acetate copolymer (molar ratio = 7:3) (0.24 g/m$^2$), and gelatin (0.6 g/m$^2$).

(7) A layer containing gelatin (0.4 g/m$^2$).

(8) A layer containing the following magenta DRR compound (0.32 g/m$^2$), tricyclohexyl phosphate (0.08 g/m$^2$), 2,5-di(tert-pentadecyl)hydroquinone (0.01 g/m$^2$), and gelatin (0.6 g/m$^2$),

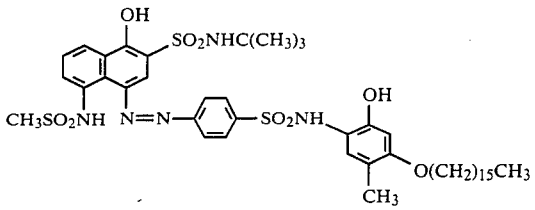

(9) A layer containing a green-sensitive, internal latent image-forming, direct reversal silver bromide emulsion (0.82 g/m$^2$ of silver), gelatin (0.9 g/m$^2$), the same nucleating agent as in layer (5) (0.03 mg/m$^2$), and sodium pentadecylhydroquinonesulfonate (0.08 g/m$^2$).

(10) A layer containing 2,5-di(tert-pentadecyl)hydroquinone (0.71 g/m$^2$), a vinylpyrrolidone/vinyl acetate copolymer (molar ratio=7:3) (0.24 g/m$^2$), and gelatin (0.6 g/m$^2$).

(11) A layer containing gelatin (0.4 g/m$^2$).

(12) A layer containing the following yellow DRR compound (0.53 g/m$^2$), tricyclohexyl phosphate (0.13 g/m$^2$), 2,5-di(tert-pentadecyl)hydroquinone (0.01 g/m$^2$), and gelatin (0.7 g/m$^2$),

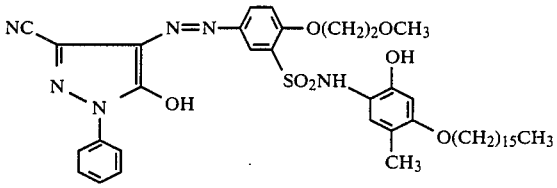

(13) A layer containing a blue-sensitive, internal latent image-forming, direct reversal silver bromide emulsion (1.09 g/m$^2$ of silver), gelatin (1.1 g/m$^2$), the same nucleating agent as in layer (5) (0.04 mg/m$^2$), and sodium pentadecylhydroquinonesulfonate (0.07 g/m$^2$).

(14) A layer containing gelatin (1.0 g/m$^2$) and 1,2-bis-(vinylsulfonylacetamide) (0.3 g/m$^2$).

0.8 g of a processing solution of the following formulation was retained in a rupturable container.

| Processing Solution | |
|---|---|
| 1-(p-Tolyl)-4-hydroxymethyl-4-methyl-3-pyrazolidinone | 6.9 g |
| tert-Butylhydroquinone | 0.2 g |
| 5-Methylbenzotriazole | 3.5 g |
| Sodium sulfite (anhydrous) | 0.2 g |
| Carboxymethyl cellulose Na salt | 58 g |
| Carbon black | 150 g |
| Potassium hydroxide (28% aq. soln.) | 200 ml |
| Benzyl alcohol | 1.5 ml |
| $H_2O$ | 580 ml |

On a transparent polyester support were coated, in sequence, the following layers to prepare a cover sheet.

(1) A layer containing an acrylic acid/butyl acrylate copolymer (80:20 by weight) (22 g/m$^2$) and 1,4-bis-(2,3-epoxypropoxy)butane (0.44 g/m$^2$).

(2) A layer containing acetyl cellulose (releasing 39.4 g of acetyl group per 100 g when hydrolyzed) (3.8 g/m$^2$), a styrene-maleic anhydride copolymer (60:40 by weight; molecular weight: about 50,000) (0.2 g/m$^2$), and 5-(β-cyanoethylthio)-1-phenyltetrazole (0.115 g/m$^2$).

(3) A layer containing a vinylidene chloride/methyl acrylate/acrylic acid (85:12:3 by weight) copolymer latex (2.5 g/m$^2$) and polymethyl methacrylate latex (particle size: 1 to 3μ) (0.05 g/m$^2$).

As comparative samples to be compared with the foregoing five light-sensitive sheets, Light-Sensitive Sheets R-1 to R-3 were prepared changing only the solvent in layer (4) to known high-boiling solvents. Each of Samples 1 to 5 and Comparative Samples R-1 to R-3 was exposed for 2 seconds from the transparent support side in an exposure amount of 100,000 lux, then integrated into a film unit together with the above-described cover sheet and the processing solution, and the processing solution was spread in a thickness of 80 μm at 25° C. by means of pressure-applying members. Density of transferred dye images was measured to obtain the results given in Table 1.

TABLE 1

| Light-Sensitive Sheet | Compound No. | Maximum Image Density | | |
|---|---|---|---|---|
| | | Red | Green | Blue |
| 1 | 10 | 2.30 | 2.20 | 1.80 |
| 2 | 29 | 2.30 | 2.20 | 1.79 |
| 3 | 30 | 2.29 | 2.20 | 1.80 |
| 4 | 31 | 2.28 | 2.18 | 1.78 |
| 5 | 44 | 2.29 | 2.19 | 1.79 |
| R-1 | A | 2.02 | 2.02 | 1.75 |
| R-2 | B | 2.01 | 2.02 | 1.76 |
| R-3 | C | 2.02 | 2.03 | 1.76 |

Compound A: tricyclohexyl phosphate
Compound B: dibutyl phthalate
Compound C: N,N—diethyllaurylamide The organic solvents of the present invention represented by the general formula (I) provided higher maximum image density (Dmax) than the known high-boiling solvents used in the comparative samples. When only the above-described cyan color material layer was coated on a transparent polyester support, the dry film of R-1 to R-3 showed a yellow hue, whereas that of Samples 1 to 5 showed a cyan hue. Thus, the cyan color layer in accordance with the present invention proved to function as a more effective light barrier layer for the adjacent red-sensitive reversal emulsion layer.

EXAMPLE 2

On a transparent polyester support were coated, in sequence, the following layers to prepare light-sensitive sheets.

(1) A layer containing the following positive type dye image-providing compound D (0.60 g/m$^2$), the following electron donor precursor E (0.62 g/m$^2$), one of ten solvents of the present invention given in Table 2 (0.95 g/m$^2$), a negative silver bromoiodide emulsion (0.88 g/m$^2$ of silver) and gelatin (1.67 g/m$^2$),

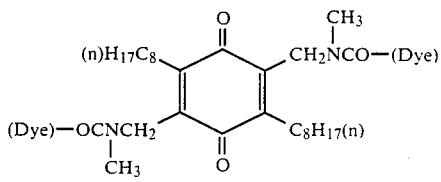

Compound D wherein (Dye)-represents:

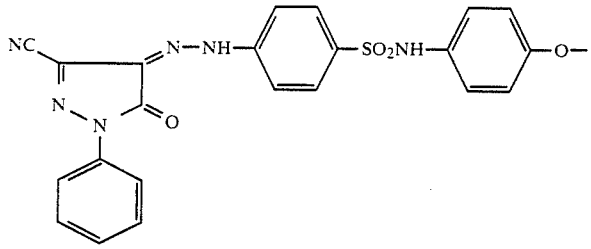

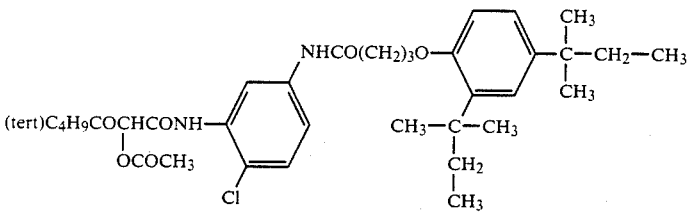

Compound E (2) A gelatin layer (1.0 g/m$^2$).

These two layers were hardened with 1,2-bis-(vinylsulfonylacetamide)ethane.

For the purpose of comparison, Comparison Light-Sensitive Sheets R-4 to R-7 were prepared in the same manner except for using known solvents in place of the solvent of the present invention. Then, a processing solution of the following formulation was spread at 25° C. in a thickness of 80 μm between the above-described light-sensitive sheet and an image-receiving sheet comprising a transparent support having coated thereon poly(vinylbenzyltrihexylammonium chloride) in an amount of 3.0 g/m$^2$ and gelatin in an amount of 3.0 g/m$^2$.

| Formulation of Processing Solution | |
|---|---|
| Carboxymethyl cellulose sodium salt | 60 g |
| 5-Methyl-1,2,3-benzotriazole | 2.5 g |
| 4-Methyl-4-hydroxymethyl-3-pyrazolidinone | 3.0 g |
| Benzyl alcohol | 1.5 g |
| Potassium hydroxide | 42 g |
| Potassium bromide | 20 g |
| Water | 730 ml |

After 2 minutes, the image-receiving sheet was delaminated from the light-sensitive sheet, washed with water, stabilized with a McIlvaine buffer having a pH of 6.0, and maximum and mimimum image densities (Dmax and Dmin) of the thus obtained reversal dye images were measured using blue light. Results thus obtained are tabulated in Table 2.

TABLE 2

| Light-Sensitive Sheet | Compound No. | Dmax | Dmin |
|---|---|---|---|
| 6 | 1 | 1.35 | 0.04 |
| 7 | 3 | 1.27 | 0.04 |
| 8 | 7 | 1.18 | 0.04 |
| 9 | 10 | 1.40 | 0.04 |
| 10 | 15 | 1.13 | 0.04 |
| 11 | 16 | 1.27 | 0.04 |
| 12 | 19 | 1.32 | 0.04 |
| 13 | 28 | 1.18 | 0.04 |
| 14 | 32 | 1.36 | 0.04 |
| 15 | 45 | 1.27 | 0.04 |
| R-4 | A | 0.85 | 0.04 |
| R-5 | B | 0.68 | 0.04 |
| R-6 | C | 0.82 | 0.04 |

TABLE 2-continued

| Light-Sensitive Sheet | Compound No. | Dmax | Dmin |
|---|---|---|---|
| R-7 | D | 0.83 | 0.04 |

D: trihexyl phosphate
A to C: Same solvents as in Table 1.

It is seen that the solvents of the present invention provided higher Dmax than the known high-boiling solvents.

EXAMPLE 3

2.88 g of positive compound F represented by the formula of compound D in Example 2 wherein the dye moiety (Dye) has the following structure:

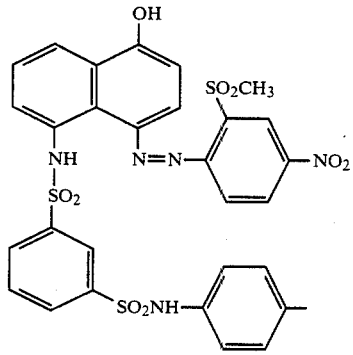

and 3.54 g of Compound E were dissolved in a mixture of 4.0 g of each oil given in Table 3 and 15 ml of dimethylformamide, and the resulting solution was emulsified and dispersed in 100 g of a 10% gelatin using soidum dodecylbenzenesulfonate as a dispersing aid. The thus obtained emulsion was washed with cold water, stored overnight at 5° C., then again dissolved and filtered to compare the amount of filtration residue. The results are shown in Table 3.

TABLE 3

| | Compound | | | | | |
|---|---|---|---|---|---|---|
| | 1 | 10 | 19 | A | B | C |
| Amount of Filtration | No | No | No | 1.5 g | 0.8 g | 0.7 g |

TABLE 3-continued

| | Compound | | | | | |
|---|---|---|---|---|---|---|
| | 1 | 10 | 19 | A | B | C |
| Residue | | | | | | |

Emulsions prepared by using the compounds of the present invention represented by the general formula (I) were stable and formed no precipitates.

While the invention has been described in detail and with reference to specific embodiments thereof, it will be apparent to one skilled in the art that various changes and modifications can be made therein without departing from the spirit and scope thereof.

What is claimed is:

1. A diffusion transfer process light-sensitive element, comprising:

a suprport having coated thereon:

a light-sensitive silver halide emulsion layer associated with a dye image-providing compound which provides a transferred dye image when processed with an alkaline processing composition, wherein said dye image-providing compound is dispersed in a photographic layer in a copresent state with a liquid comprising an organic solvent represented by the following general formula (I):

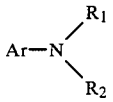

(I)

wherein $R_1$ represents a substituted or unsubstituted alkyl, aralkyl, cycloalkyl or alkenyl group, $R_2$ represents a hydrogen atom or the same substituent as defined for $R_1$, Ar represents an unsubstituted phenyl group, a methylenedioxyphenyl group, or a phenyl or naphthyl group substituted by a halogen atom, a carboxy group or a substituted or unsubstituted alkyl, aralkyl, alkenyl, cycloalkyl, alkylthio, phenyl, alkoxy, aryloxy, alkylamino, acylamino, carbamoyl, sulfonamido or sulfamoyl group, with the phenyl or naphthyl group being optionally substituted by two or more, same or different, substituents in two or more positions, or $R_1$ and $R_2$ may be connected to each other to form a ring, or either $R_1$ or $R_2$ may be connected to Ar to form a fused ring.

2. A light-sensitive element as claimed in claim 1, wherein said dye image-providing compound is a dye-releasing redox compound.

3. A light-sensitive element as claimed in claim 1, wherein said dye image-providing compound is a positive type compound, which after receiving at least one electron releases a diffusible dye.

4. A light-sensitive element as claimed in claim 1, wherein said dye image-providing compound is a compound having an azonaphthol dye moiety containing a nitro group-substituted phenyl group.

5. A light-sensitive element as claimed in claim 4, wherein said dye image-providing compound is represented by the general formula (V):

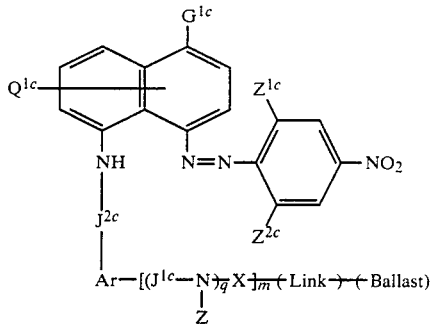

(V)

wherein:

$Q^{1c}$ is connected to either of the naphthol nucleus rings and represents a hydrogen atom, a halogen atom, a sulfamoyl group represented by $—SO_2NY^{3c}Y^{4c}$ (wherein $Y^{3c}$ represents a hydrogen atom, an alkyl group or a substituted alkyl group, $Y^{4c}$ represents a hydrogen atom or $Y^{4ac}$, $Y^{4ac}$ represents an alkyl group, a substituted alkyl group, an aralkyl group or an aryl group, or $Y^{3c}$ and $Y^{4c}$ may be connected to each other directly or via an oxygen atom to form a ring), $—SO_2Y^{5c}$ (wherein $Y^{5c}$ represents an alkyl group, a substituted alkyl group or a benzyl group), a carboxyl group, $—COOY^{6c}$ (wherein $Y^{6c}$ represents an alkyl group, a substituted alkyl group, a phenyl group or a substituted phenyl group) or $—CONY^{3c}Y^{4c}$ (wherein $Y^{3c}$ and $Y^{4c}$ are the same as defined above);

$J^{2c}$ represents $—SO_2—$ or —CO—;

Ar represents a phenylene group or a substituted phenylene group;

$Z^{1c}$ represents a halogen atom, a cyano group, a nitro group, a trifluoromethyl group, an alkyl group, an alkoxy group, a carboxyl group, a carboxylic acid ester group represented by $—COOY^{6c}$ (wherein $Y^{6c}$ is the same as defined above), a fluorosulfonyl group, a phenoxysulfonyl group, a substituted phenoxysulfonyl group, a sulfamoyl group represented by $—SO_2NY^{3c}Y^{4c}$ (wherein $Y^{3c}$ and $Y^{4c}$ are the same as defined above), a carbamoyl group represented by $—CONY^{3c}Y^{4c}$ (wherein $Y^{3c}$ and $Y^{4c}$ are the same as defined above), an alkylsulfonyl group, a substituted alkylsulfonyl group, a phenylsulfonyl group or a substituted phenylsulfonyl group;

$Z^{2c}$ represents a hydrogen atom, a halogen atom, a nitro group, a cyano group or a trifluoromethyl group;

$J^{1c}$ represents $—SO_2—$ or —CO—;

Z represents a hydrogen atom, an alkyl group or a substituted alkyl group;

X represents a divalent linking group represented by $—A_1—(L)_l—(A_2)_p—$ (wherein $A_1$ and $A_2$, which may be the same or different, each represents an alkylene group or an arylene group, L represents a divalent group selected from the group consisting of oxy, carbonyl, carboxyamido, carbamoyl, sulfonamido, sulfamoyl, sulfinyl, sulfonyl and a mixture thereof, and l and p each represents 0 or 1);

m and q each represents 0 or 1;

$G^{1c}$ represents a hydroxy group or a group capable of providing a hydroxy group by hydrolysis;

(Link) represents a redox-cleavage group which undergoes cleavage by oxidation upon development or undergoes, to the contrary, depression of cleavage; and (Ballast) represents a ballast group for immobilizing the compound under alkaline processing conditions.

6. A light-sensitive element as claimed in claim 1, wherein the compound represented by the general formula (I) is a compound represented by the general formula selected from the group consisting of (II) and (III):

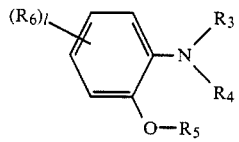

(II)

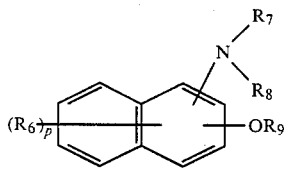

(III)

wherein $R_3$, $R_4$, $R_5$, $R_7$, $R_8$ and $R_9$, which may be the same or different, each represents a substituted or unsubstituted alkyl, alkenyl, cycloalkyl or aralkyl group, $R_6$ represents a hydrogen atom, a halogen atom, or a substituted or unsubstituted alkyl, aralkyl, alkenyl, cycloalkyl, alkylamino, alkylthio, phenyl or aryloxy group, with

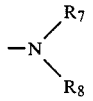

and —O—$R_9$ being in an o-position with each other, l represents 0 or an integer of 1 to 4, p represents 0 or an integer of 1 to 6 and, when two or more $R_6$'s exist in one and the same molecule, they may be different from each other.

7. A light-sensitive element as claimed in claim 6, wherein said compound represented by the general formula (I) is a compound represented by the general formula (II).

8. A light-sensitive element as claimed in claim 3, wherein the positive type compound is a compound represented by the general formula (VII):

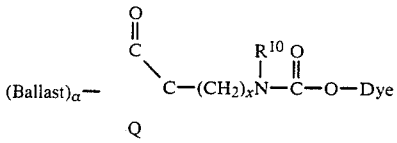

(VII)

wherein (Ballast) is a ballast group for immobilizing the compounds under alkaline processing conditions, Q represents a quinone nucleus which may be substituted, x represents an integer of 1 or 2, $R^{10}$ represents an alkyl or substituted alkyl group containing 1 to about 40 carbon atoms or an aryl or substituted aryl group containing 6 to 40 carbon atoms, α represents 0 or 1 and, when $R^{10}$ represents a group containing not more than 8 carbon atoms, α represents 1.

9. A light-sensitive element as claimed in claim 1, wherein the dye image-providing compound is represented by the general formula (VI):

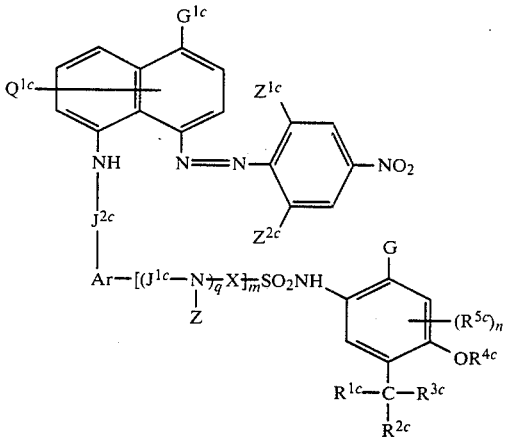

(VI)

wherein:

G represents a hydroxy group or a group capable of providing a hydroxy group by hydrolysis;

$R^{1c}$ and $R^{2c}$, which may be the same or different, each represents an alkyl group or an aromatic group, or $R^{1c}$ and $R^{2c}$ may be connected to each other to form a ring;

$R^{3c}$ represents a hydrogen atom, an alkyl group or an aromatic group;

$R^{4c}$ represents an alkyl group or an aromatic group;

$R^{5c}$ represents an alkyl group, an alkoxy group, an alkylthio group, an arylthio group, a halogen atom or an acylamino group;

n represents 0, 1 or 2;

$R^{4c}$ and $R^{5c}$ may be connected to each other to form a fused ring;

$R^{1c}$ and $R^{4c}$ may be connected to each other to form a fused ring;

$R^{1c}$ and $R^{5c}$ may be connected to each other to form a fused ring;

the sum of the carbon atoms contained in $R^{1c}$, $R^{2c}$, $R^{3c}$, $R^{4c}$ and $(R^{5c})_n$ is more than 7;

$Q^{1c}$ is bound to either of the rings of the naphthol nucleus and represents a hydrogen atom, a halogen atom, a sulfamoyl group represented by —$SO_2$-$NY^{3c}Y^{4c}$ (wherein $Y^{3c}$ represents a hydrogen atom, an alkyl group or a substituted alkyl group, $Y^{4c}$ represents a hydrogen atom or $Y^{4ac}$, $Y^{4ac}$ represents an alkyl group, a substituted alkyl group, an aralkyl group or an aryl group, or $Y^{3c}$ and $Y^{4c}$ may be connected to each other directly or via an oxygen atom to form a ring), —$SO_2Y^{5c}$ (wherein $Y^{5c}$ represents an alkyl group, a substituted alkyl group or a benzyl group), a carboxyl group, —$COOY^{6c}$ (wherein $Y^{6c}$ represents an alkyl group, a substituted alkyl group, a phenyl group or a substituted phenyl group) or —$CONY^{3c}Y^{4c}$ (wherein $Y^{3c}$ and $Y^{4c}$ are the same as defined above);

$J^{2c}$ represents —$SO_2$— or —CO—;

Ar represents a phenylene group or a substituted phenylene group;

$Z^{1c}$ represents a halogen atom, a cyano group, a nitro group, a trifluoromethyl group, an alkyl group, an alkoxy group, a carboxyl group, a carboxylic acid ester group represented by —$COOY^{6c}$ (wherein $Y^{6c}$ is the same as defined above), a fluorosulfonyl group, a phenoxysulfonyl group, a substituted phenoxysulfonyl group, a sulfamoyl group represented by —$SO_2NY^{3c}Y^{4c}$ (wherein $Y^{3c}$ and $Y^{4c}$ are the same as defined above), a carbamoyl group represented by —$CONY^{3c}Y^{4c}$ (wherein $Y^{3c}$ and $Y^{4c}$ are the same as defined above), an alkylsulfonyl group, a substituted alkylsulfonyl group, a phenylsulfonyl group or a substituted phenylsulfonyl group;

$Z^{2c}$ represents a hydrogen atom, a halogen atom, a nitro group, a cyano group or a trifluoromethyl group;

$J^{1c}$ represents —$SO_2$— or —CO—;

Z represents a hydrogen atom, an alkyl group or a substituted alkyl group;

X represents a divalent linking group represented by —$A_1$—$(L)_l$—$(A_2)_p$— (wherein $A_1$ and $A_2$, which may be the same or different, each represents an alkylene group or an arylene group, L represents a divalent group selected from the group consisting of oxy, carbonyl, carboxyamido, carbamoyl, sulfonamido, sulfamoyl, sulfinyl and sulfonyl, and l and p each represents 0 or 1);

m and q each represents 0 or 1; and $G^{1c}$ represents a hydroxy group or a group capable of providing a hydroxy group by hydrolysis.

10. A light-sensitive element as claimed in claim 1, wherein the compound of the general formula (I) is present in an amount of 5 mol% to 500 mol% based on the amount of the dye image-providing compound.

11. A light-sensitive element as claimed in claim 10, wherein the compound of the general formula (I) is present in an amount in the range of 10 mol% to 300 mol% based on the amount of the dye image-providing compound.

12. A light-sensitive element as claimed in claim 2, wherein the dye-releasing redox compound is present in an amount of $1\times10^{-4}$ to $1\times10^{-2}$ mol/m$^2$.

13. A light-sensitive element as claimed in claim 12, wherein the dye-releasing redox compound is present in an amount in the range of $2\times10^{-4}$ to $2\times10^{-3}$ mol/m$^2$.

14. A light-sensitive element as claimed in claim 2, wherein the dye-releasing redox compound is dispersed in a solvent containing 50 wt% or more of the compound represented by the general formula (I).

15. A light-sensitive element as claimed in claim 1, wherein said dye image-providing compound is, when processed with an alkaline processing composition, initially either mobile or immobile in the light-sensitive element.

16. A light-sensitive element as claimed in claim 1, wherein said dye image-providing compound is a compound which forms or releases, when processed with an alkaline processing composition, a diffusible dye selected from the group consisting of an azo dye, an anthraquinone dye and a phthalocyanine dye.

17. A light-sensitive element as claimed in claim 1, wherein said dye image-providing compound is an azo dye.

18. A light-sensitive element as claimed in claim 1, wherein said dye image-providing compound is dispersed in a photographic layer in a co-present state with a liquid consisting essentially of the organic solvent represented by general formula (I).

* * * * *